US006225608B1

(12) United States Patent
Källgren

(10) Patent No.: US 6,225,608 B1
(45) Date of Patent: May 1, 2001

(54) CIRCULAR FILM HEATER

(75) Inventor: Johan Källgren, Bromma (SE)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/451,733

(22) Filed: Nov. 30, 1999

(51) Int. Cl.[7] ..... H05B 3/68; H01C 1/012

(52) U.S. Cl. ..... 219/465.1; 219/466.1; 338/307

(58) Field of Search ..... 219/465.1, 466.1, 219/460.1, 461.1, 462.1, 542, 544; 338/306, 307, 308, 309

(56) References Cited

U.S. PATENT DOCUMENTS

| | | |
|---|---|---|
| 851,440 | 4/1907 | Rivers . |
| 1,352,934 | 9/1920 | Arntzen et al. . |
| 2,026,797 | 1/1936 | Pierson . |
| 3,167,638 | 1/1965 | Hornaday, Jr. et al. . |
| 3,694,627 | 9/1972 | Blatchford et al. . |
| 3,895,216 | 7/1975 | Hurko . |
| 4,002,883 | 1/1977 | Hurko . |
| 4,233,497 | 11/1980 | Lowell . |
| 4,384,192 | 5/1983 | Lowell et al. . |
| 4,508,961 | 4/1985 | McWilliams . |
| 4,538,051 | 8/1985 | Schreder et al. . |
| 4,843,218 | 6/1989 | Husslein et al. . |
| 4,860,434 | 8/1989 | Louison et al. . |
| 4,970,375 | 11/1990 | Schittenhelm et al. . |
| 4,973,826 | 11/1990 | Baudry et al. . |
| 5,019,691 | 5/1991 | Lai . |
| 5,043,599 | 8/1991 | Scott . |
| 5,160,830 | 11/1992 | Kicherer et al. . |
| 5,270,519 | 12/1993 | Higgins . |
| 5,331,134 | 7/1994 | Kimura . |
| 5,352,864 | 10/1994 | Schultheis et al. . |
| 5,471,737 | 12/1995 | McWilliams . |
| 5,512,731 | 4/1996 | McWilliams . |
| 5,616,266 | 4/1997 | Cooper . |

*Primary Examiner*—Sang Paik
(74) *Attorney, Agent, or Firm*—Pearne & Gordon LLP

(57) ABSTRACT

A range cook top is provided with circular heating zones having a layer of resistive thin film thereon. Slots in the cook top separate the heating zones from the surrounding areas of the cook top. The heating zone includes a resistive layer elements formed by a rectangular layer surrounded by annular arcuate segments. Power supply bus bars are disposed around edges of the resistive layer elements. A dual heater has separately controlled rectangular and annular resistive elements. Temperature sensors are also provided.

22 Claims, 6 Drawing Sheets

CIRCULAR FILM HEATER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates generally to the field of heating and cooking and specifically to a resistance heater.

Electrical resistance heating films are used in various applications. Typically, the resistive film is applied on a substrate, which may provide a heating surface or may be the surface to be heated. A controlled voltage or current is applied to the film to effect the creation of heat energy. Examples of film heaters and controllers therefor are described in U.S. Pat. Nos. 4,233,497 to Lowell, 4,384,192 to Lowell, 4,973,826 to Baudry, 5,160,830 to Kicherer and 5,616,266 to Cooper. U.S. patent application Ser. No. 09/067,135 also shows a film heater and related components.

Range cook tops for cooking food use electric heaters. It is desirable to provide a durable surface for supporting objects so that the objects can be heated efficiently and reliably. Heating of the surface should be limited to a desired area.

BRIEF SUMMARY OF THE INVENTION

The invention provides a heater including a substrate having a heating zone. A resistive layer is disposed on at least part of the substrate heating zone and forms an annular heating element divided into arcuate segments. Conductive bus bars electrically connecting the arcuate segments in series.

The bus bars are disposed on edges of the arcuate segments. The bus bars are respectively connected along inner and outer edges of the arcuate segments. A first one of the bus bars is connected along a first edge of a first one of the arcuate segments and a second one of the bus bars is connected along a second edge of the first arcuate segment opposite the first edge and along an edge of a second one of the arcuate segments.

According to one aspect of the invention, the resistive layer includes first, second, third, and fourth of the arcuate segments, a first one of the bus bars is connected along an outer edge of the first segment, a second one of the bus bars is connected along inner edges of the first and second segments, a third one of the bus bars is connected along outer edges of the second and third segments, a fourth one of the bus bars is connected along inner edges of the third and fourth segments, and a fifth one of the bus bars is connected along an outer edge of the fourth segment. The first and fifth bus bars are connected to a power source.

According to another aspect of the invention, the resistive layer includes first, second, third, fourth, fifth, sixth, seventh, and eighth of the arcuate segments, a first one of the bus bars is connected along an inner edge of the first segment, a second one of the bus bars is connected along outer edges of the first and second segments, a third one of the bus bars is connected along inner edges of the second and third segments, a fourth one of the bus bars is connected along outer edges of the third and fourth segments, a fifth one of the bus bars is connected along inner edges of the fourth and fifth segments, a sixth one of the bus bars is connected along outer edges of the fifth and sixth segments, a seventh one of the bus bars is connected along inner edges of the sixth and seventh segments, an eighth one of the bus bars is connected along outer edges of the seventh and eighth segments, and a ninth one of the bus bars is connected along an inner edge of the eighth segment. The first and ninth bus bars are connected to a power source.

The resistive layer also includes a separate element disposed within the annular element and conductive bus bars disposed along opposite edges of the separate element. The separate element bus bars are connected to the annular element bus bars so that the separate element is electrically connected in parallel with the annular element. The separate element bus bars are arranged so that power to the separate element can be controlled separately from the annular element.

A resistive lead is connected from a conductive element disposed adjacent the resistive layer to a temperature sensor. The conductive element is one of the bus bars. A conductive lead is connected to the conductive element. These leads are connected to a controller for monitoring the temperature of the heater.

Gaps between different segments of the resistive layer are filled with insulating material. A dielectric layer is disposed between the resistive layer and the substrate.

According to one aspect, the invention provides a heater including a substrate having a heating zone. A resistive layer is disposed on at least part of the substrate heating zone and forms an annular heating element divided into arcuate segments and a rectangular element disposed within the annular element. Annular element conductive bus bars are disposed on edges of the arcuate segments electrically connecting the arcuate segments in series, wherein a first one of the annular element bus bars is connected along a first edge of a first one of the arcuate segments and a second one of the annular element bus bars is connected along a second edge of the first arcuate segment opposite the first edge and along an edge of a second one of the arcuate segments, a last one of the annular element bus bars is connected along an edge of a last one of the arcuate segments in the series, and the first and last annular element bus bars are connected to a power source. Rectangular element conductive bus bars are disposed along opposite edges of the rectangular element and connected to the power source.

The rectangular element bus bars are connected to the annular element bus bars so that the rectangular element is electrically connected in parallel with the annular element. The rectangular element bus bars are arranged so that power to the rectangular element can be controlled separately from the annular element. A resistive temperature sensing lead is connected to a conductive element disposed adjacent the resistive layer, wherein the temperature sensing leads are connected to a controller for monitoring the temperature of the heater.

DESCRIPTION OF THE INVENTION

Figure 1:
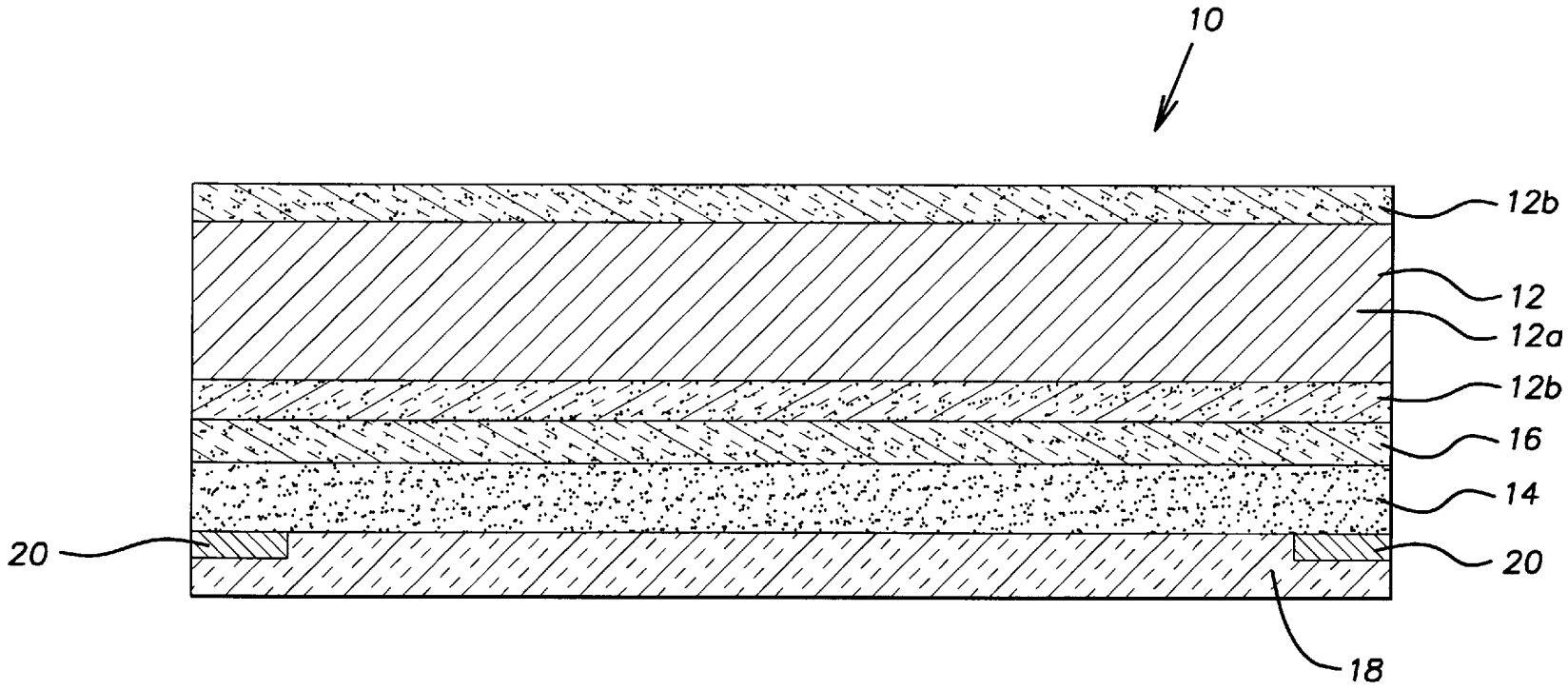
FIG. 1 shows a schematic elevational view of a heating element according to the invention.

Referring to FIG. 1, a heating apparatus, such a range cook top 10, includes a generally horizontal planar surface forming a substrate 12. A heating zone is formed on the substrate 12 and includes a resistive film layer 14 deposited on the substrate. A dielectric layer 16 can be disposed between the resistive film layer 14 and the substrate 12. A sealing layer 18 can be disposed over the resistive film 14. FIG. 1 is schematic and the relative thicknesses of the layers do not represent actual thicknesses. The components described above are described in more detail below and in U.S. patent application Ser. No. 08/800,738.

The substrate 12 is preferably a thermal shock resistant, rigid, and planar structure having a low electrical conductivity. In some applications, the substrate is suitable for supporting objects to be heated. In a domestic range cook top application, for example, the substrate 12 is supported by a frame of the range and forms the base of the cook top. The substrate 12 can be glass ceramic, such as $Li_2Al_2Si_2O_6$ beta-quartz (LAS), available from Eurokera or Schott. For example, LAS glass ceramic or $Si_3N_4$ ceramic about 4.0 mm thick can be used in some cases. Also suitable is porcelain enameled (P-E) steel about 2.5 mm thick, that is, 2.0 mm of steel 12*a* with about 0.25 mm of porcelain enamel 12*b* on each side. Examples of materials suitable for use as the substrate 12 include, but are not limited to, porcelainized carbon steel, porcelainized ferritic stainless steel, aluminum oxide, glass ceramic commonly referred to as Ceran, $Si_3N_4$-ceramic, and combinations of the foregoing.

The resistive film 14 is preferably a thin film of atmospheric chemical vapor deposition (ACVD) applied F-doped or Sb-doped $SnO_2$ able to withstand a power density of 1.5 to 14 $W/cm^2$ and a current density between 11,000 and 90,000 $A/cm^2$. A preferred dopant for tin dioxide is 0.1 to 0.5 weight percent fluorine. The film has a surface resistance of 75 Ohms per square. A voltage applied across the film causes a current to flow through the film thereby heating the film. Preferably, the thin film has a positive temperature coefficient (PTC) to prevent thermal run away. Other materials having the desired properties may also be suitable, such as a cermet-based thick film material, a polymer-based thick film material, or any type of electrically resistive film or coating. Because its resistance varies as a function of temperature, the resistive film can also be used as a temperature sensor. Alternatively, a separate temperature sensor can be located at the heating zone for closed loop temperature control.

One layer of the porcelain enamel 12*b* acts as a dielectric layer. When the substrate is glass ceramic, the dielectric layer 16 is preferably a sol gel applied $SiO_2/Al_2O_3$ or a screen printed and fired glass layer. The dielectric layer preferably insulates the substrate from currents flowing in the resistive film 14 and has a dielectric constant of about 5 to 8 (at room temperature and 50–60 Hz). The dielectric constant should be as low and as stable as possible over the operating temperature range of the heater, which is about 20° C. to 500° C. The dielectric layer should not substantially limit heat conduction from the resistive film to the substrate. Other materials having the desired properties may also be suitable. Examples of such materials include titanium dioxide, inorganic high temperature cements, sealing glasses, sol gel applied ceramics such as zirconia applied as a sol gel, high temperature paint, plasma or flame sprayed ceramics, or combinations thereof. The dielectric material selected preferably has a coefficient of thermal expansion as close to the substrate 12 as possible. A specific example of a preferred material for the dielectric layer is a glass layer fused to a glass ceramic substrate. Such fusing can be performed at temperatures in the range of 600° C. to 850° C. This can be applied via atmospheric chemical vapor deposition. A further specific example of a preferred material for the dielectric layer is a ceramic material, for instance an alumina-based ceramic material, that is plasma sprayed or HVOF sprayed.

The sealing layer 18 is a heat resistant, rigid material having high electrical insulating properties and high heat conductivity. The sealing layer resists corrosion of the resistive layer. Preferably, ACVD applied $SiO_2$ is used.

Electrically conductive bus bars 20, such as cermet based silver thick film, are disposed on the resistive film layer 14 and preferably covered by the sealing layer 18. The thickness of each electrode 20 is from about 5 to about 25 micrometers. The bus bars are preferably about 1.5 mm wide. The bus bars 20 are connected to a power supply for providing a controlled current or voltage to the resistive film 14. The bus bar configurations and connections are discussed below.

Figure 2:
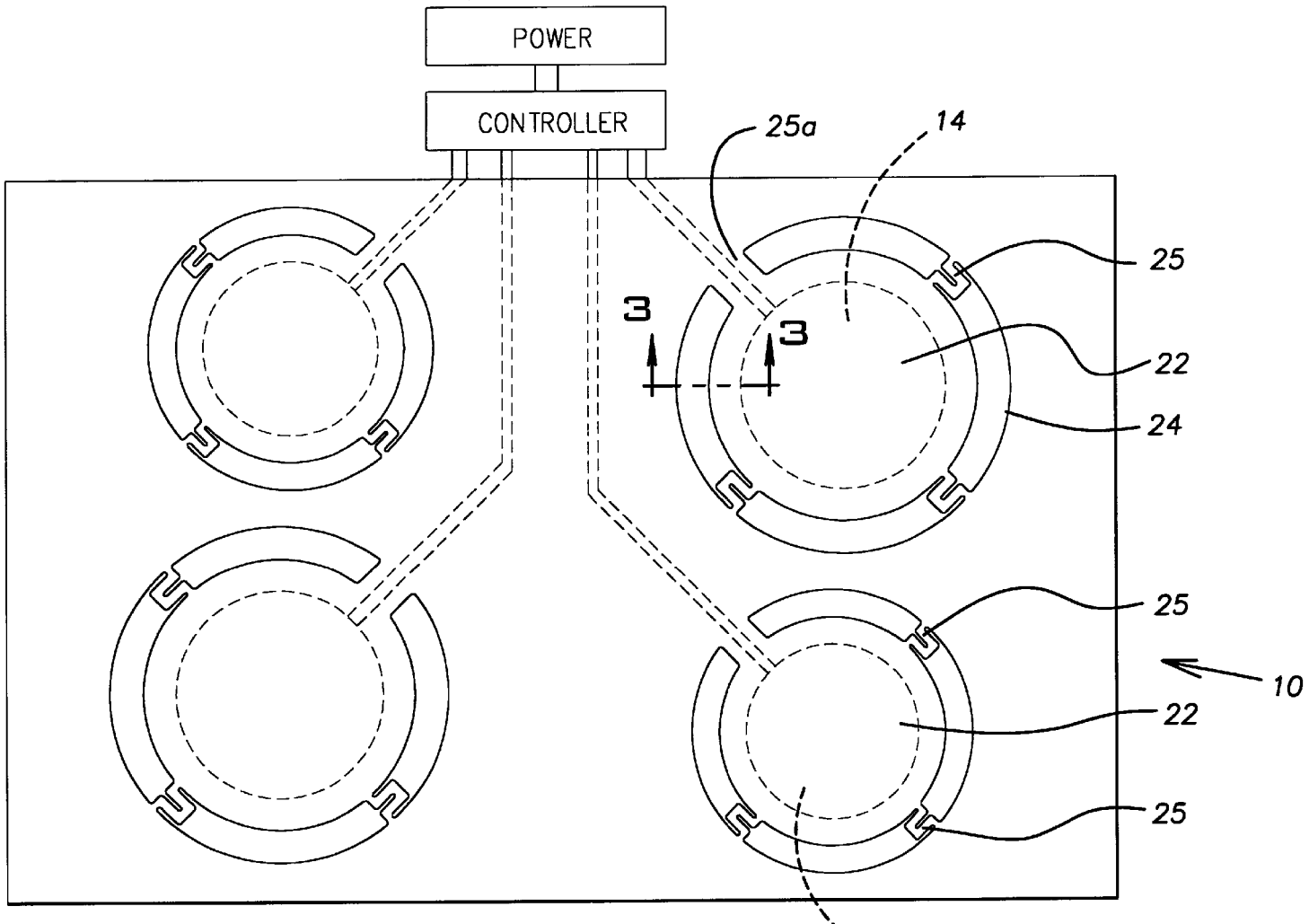
FIG. 2 shows a schematic top view of a range cook top having a porcelain-enameled steel substrate according to the invention.

Referring to FIG. 2, the cook top 10 includes several heating zones 22. Each heating zone 22 includes resistive film and bus bars disposed on the substrate as discussed above. Preferably, the heating zones 22 are circular and correspond in size with conventional large and small cook top element sizes, for example, about 235 mm and 160 mm in diameter. When a P-E steel substrate is used, the heating zone 22 is separated from the remaining area of the cook top 10 by a circumferential slot 24. The slot 24 thermally insulates the cook top 10 from the heating zone 22. The resistive film does not extend past the slot. The slot 24 is discontinuous, interrupted by circumferentially spaced tongues 25. The tongues provide mechanical support for the heating zone and can provide a path for running electrical connections, such as conductive bus bar layers. The electrical connections are connected to a power source through a controller. Preferably, the tongues 25 are formed by leaving substrate material when the slot 24 is formed. Thus, the tongues have the same thickness as the substrate, but do not have porcelain enamel applied thereto expect where a path is provided for electrical conductors, wherein the enamel provides electrical insulation between the substrate and electrical conductors. One of the tongues 25*a* extends directly across the slot to serve as a bridge for simple routing of the bus bars. The other tongues 25 follow a serpentine path across the slot. The serpentine tongues allow for thermal expansion of the cook top elements. The width and number of tongues are selected to provide support for the physical loads placed on the heating zone. Alternatively, the tongues 25 can be separate parts, such as insulating fasteners, added to secure the heating zone to the cook top. Inserts and sealers are provided in the slots. These are described in more detail in U.S. patent application Ser. No. 09/067,135. When a glass ceramic substrate is used, the slots are not necessary and the substrate can be formed as a continuous sheet.

Figure 3:
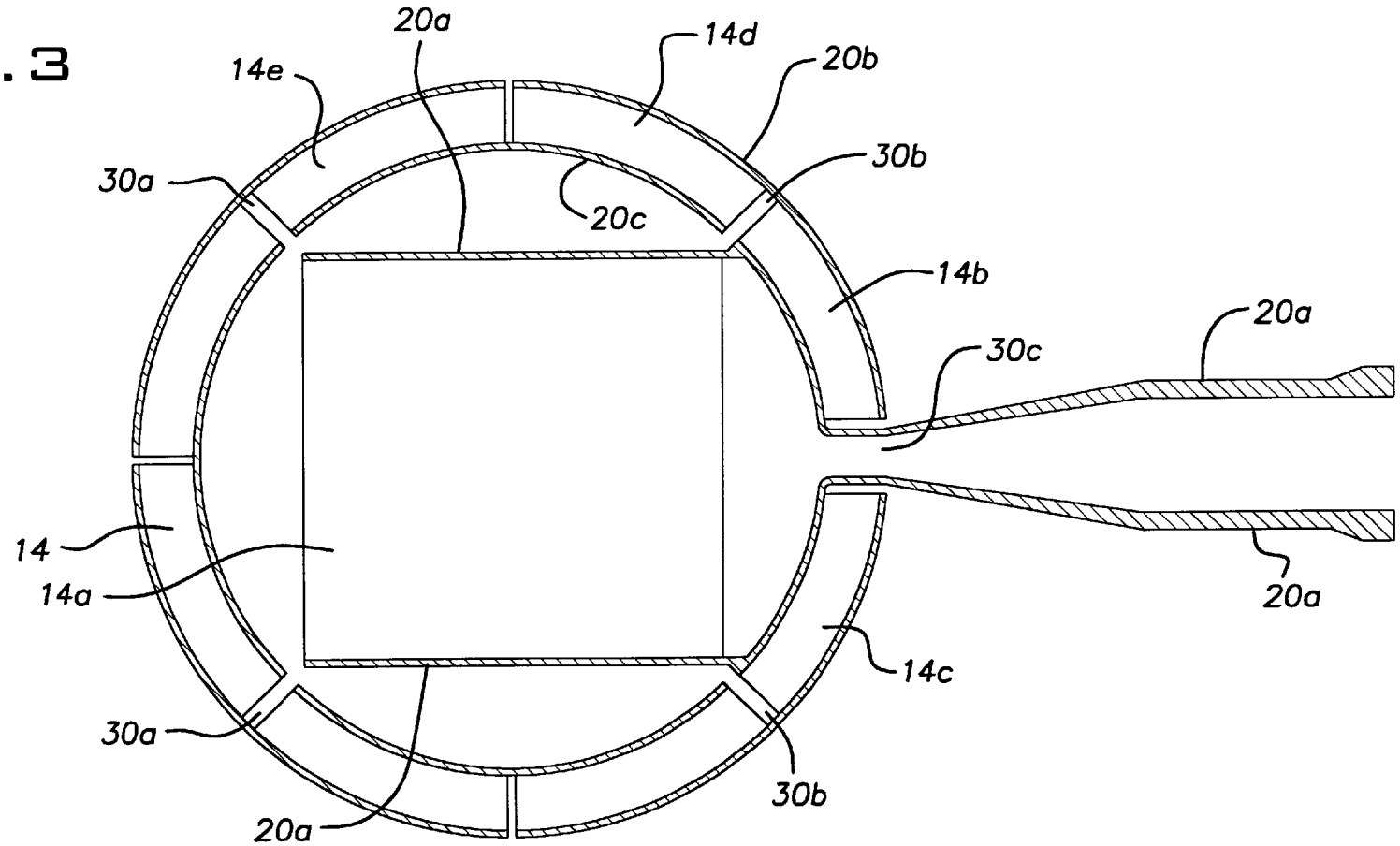
FIG. 3 shows a schematic diagram of the electrical layout of a single heater according to one aspect of the invention.

Referring to FIG. 3, the arrangement of the bus bars and resistive layer are shown as they would appear from the bottom of the cook top with the bus bars being applied on the resistive layer. The resistive layer 14 is applied as a nearly square rectangular element surrounded by an annular element formed by eight arcuate segments. The rectangular element 14*a* is approximately 80 mm by 85 mm. The arcuate segments have an outer radius of about 74 mm and an inner radius of about 60.5 mm. The segments are generally symmetrically spaced around the rectangular element 14*a*. Gaps 30 between the segments are 4 mm wide at the corners of the rectangle and 2 mm wide at the major axes of the rectangle. A 15 mm gap 30*c* is provided between two of the segments to provide a passage for main bus bars 20*a*. The gaps provide electrical insulation between different elements of the resistive layer. Gap width and location can be modified to alter the electrical and heating characteristics. For example, locating gaps 30*a* at 43° from the vertical axis provides relatively even heating. Also, the maximum power density can be reduced from 13.5 W/cm$^2$ to 12.6 W/cm$^2$ by making gaps 30*b* 2 mm wide instead of 4 mm wide.

The resistive layer elements and conductive elements are electrically insulated from each other by the gaps 30. When a sealing layer (18 in FIG. 1) is provided, the sealant can fill the gaps to provide additional insulation.

The main bus bars 20*a* are connected to respective legs to a power source, such as a two-phase power system providing a nominal 240 volts AC. The main bus bars are spaced 8 mm apart in the gap 30*c*, and include terminals connected to leads from the power source. The main bus bars 20*a* supply power to the bus bars applied on the resistive layer elements. FIG. 3 shows a single heater in that all of the elements of the resistive layer are supplied from the same main bus bars. The terminals are spaced about 30 to 300 mm from the heating zone to reduce the effects of heat on the connections. For example, the bus bars are run along one of the tongues (25*a*, FIG. 2) supporting the heating zone so that the terminals are located on a cooler part or edge of the cook top.

The bus bars extend along the inner edge of the first arcuate segment 14*b* and the eighth arcuate segment 14*c*. These bus bars 20*a* continue and extend along opposite edges of the rectangular element 14*a*. The arcuate segments 14 are connected by bus bars 20 extending along outer and inner edges of pairs of the arcuate segments. For example, a bus bar 20*b* extends along the outer edges of the first and second arcuate segments 14*b*, 14*d*. Another bus bar 20*c* extends along the inner edge of the second and third arcuate segments 14*d*, 14*e*. The arcuate segments are connected in a series circuit beginning at one of the main bus bars 20*a* and ending at the other main bus bar 20*a*. Thus, the rectangular element is connected in parallel with the arcuate segments. This arrangement provides about 1140 W at 240VAC.

Figure 4:
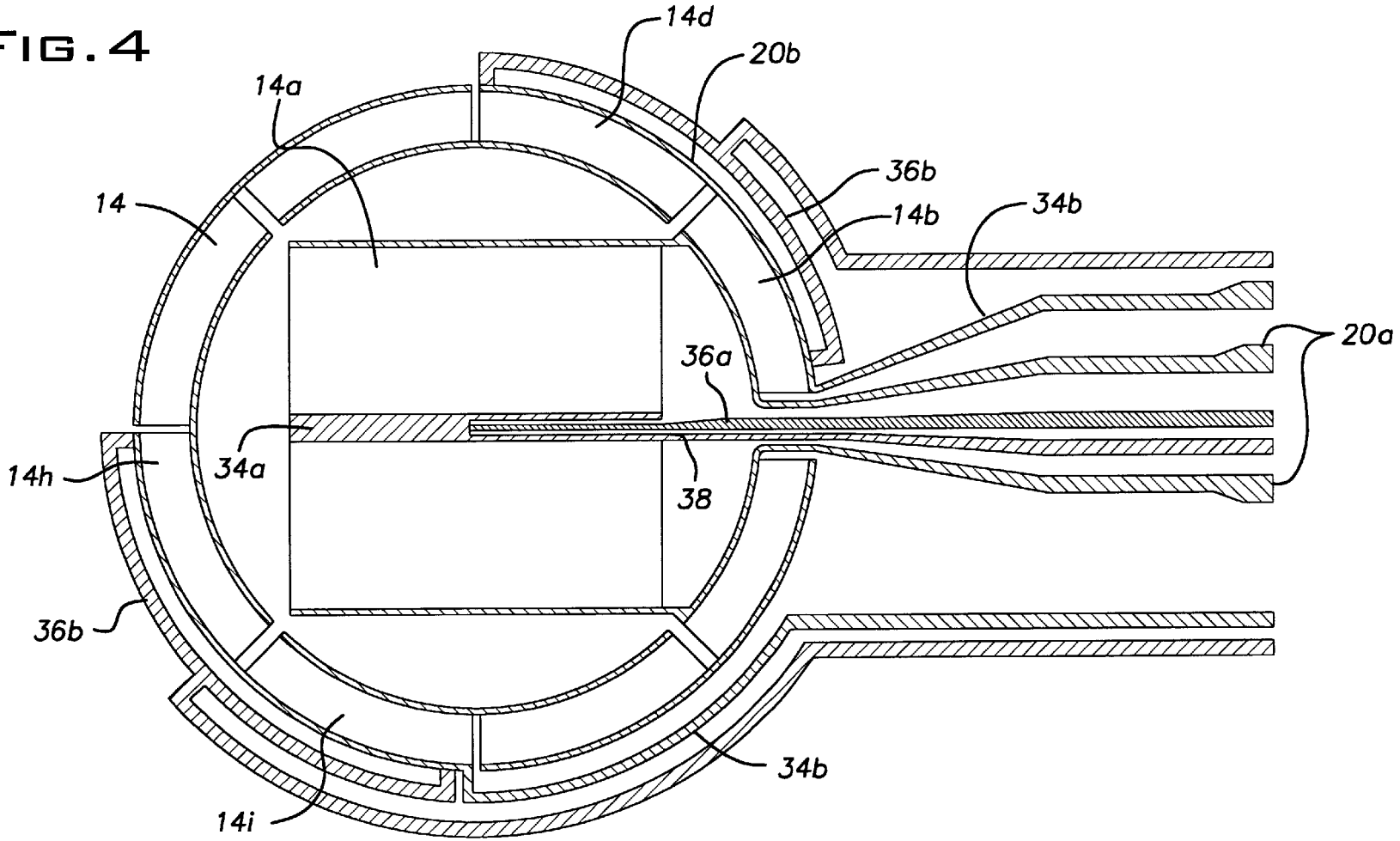
FIG. 4 shows a schematic diagram of the electrical layout of a single heater having temperature sensing according to the invention.

Referring to FIG. 4, the heater includes substantially the same configuration of resistive layer elements 14 and bus bars 20 as shown in FIG. 3. That is, the resistive layer 14 is applied as a nearly square rectangular element surrounded by an annular element formed by eight arcuate segments. The rectangular element 14*a*, however, is divided into two separate rectangular elements by a 5 mm gap 38. The arcuate segments 14 are connected by bus bars 20 extending along outer and inner edges of pairs of the arcuate segments. The main bus bars 20*a* are connected to respective legs of a two-phase power system providing a nominal 240 volts AC.

Temperature sensing circuits are added to monitor and control the temperature of the resistive layer elements. Conductive material 34, such as silver, and resistive material 36, such as tin oxide can be used as leads to a temperature sensor of the controller. The leads are applied similarly to the resistive and bus bar layers.

One sensor is formed by a temperature control resistive lead 36*a* running to the center of the rectangular resistive element 14*a*. The resistive lead 36*a* is 1 mm wide and runs in the gap 38 extending through the rectangular element 14*a*. A temperature control conductive lead 34*a* runs through the gap 38 in the rectangular resistive element 14*a* and connects the two rectangular elements forming the nearly square rectangular element. The conductive lead 34*a* is 5 mm wide across half of the rectangular element 14*a*, until the conductive lead contacts the resistive lead 36*a*, where the conductive lead then splits into two parts, each of which is 1 mm wide and spaced 1 mm from opposite sides of the resistive lead 36*a*, running to the opposite edge of the rectangular element 14*a*. The temperature control conductive lead 34*a* and resistive lead 36*a* are connected to a temperature controller, such as a PID electronic control, that monitors the temperature of the heater and controls the power to the bus bars 20 to maintain a desired temperature.

Leads to a temperature limiting sensor are formed by a temperature limiting resistive lead 36*b* following an arcuate path spaced about 3 mm from the outside edge of some of the annular resistive element arcuate segments 14. Ends of the resistive lead 36*b* extend inwardly to connect to one of the bus bars 20 on the resistive layer 14. The temperature limiting resistive leads 36*b* are 4 mm wide. A temperature limiting conductive lead 34*b* is connected to one end of the bus bar 20*b* extending along the outer edges of the first and second arcuate segments 14*b*, 14*d*. The conductive lead 34*b* is 1.5 mm wide or wider. Thus, the bus bar 20*b* connected to the conductive lead 34*b* serves the dual purposes of conducting current between the arcuate segments 14*b*, 14*d* and providing a temperature sensing signal. The resistive lead 36*b* is spaced from the conductive lead 34*b* and bus bar 20*b*, but connected to the bus bar 20*b* at or near opposite ends of the arcuate segments 14*b*, 14*d*. The resistive lead 36*b* contacts the bus bar 20*b* only where the temperature is to be sensed. Leads to the temperature limiting sensor can be provided for other arcuate segments. An example is shown for the fifth and sixth segments 14*h*, 14*i*.

The temperature limiting conductive lead 34*b* and resistive lead 36*b* are connected to the temperature controller, which monitors the temperature of the heater at the junctions of the conductive and resistive leads. If the temperature exceeds a specified maximum desired temperature, the controller overrides the control based on the signals from the temperature control sensors and reduces or cuts off power to the bus bars 20.

Figure 5:
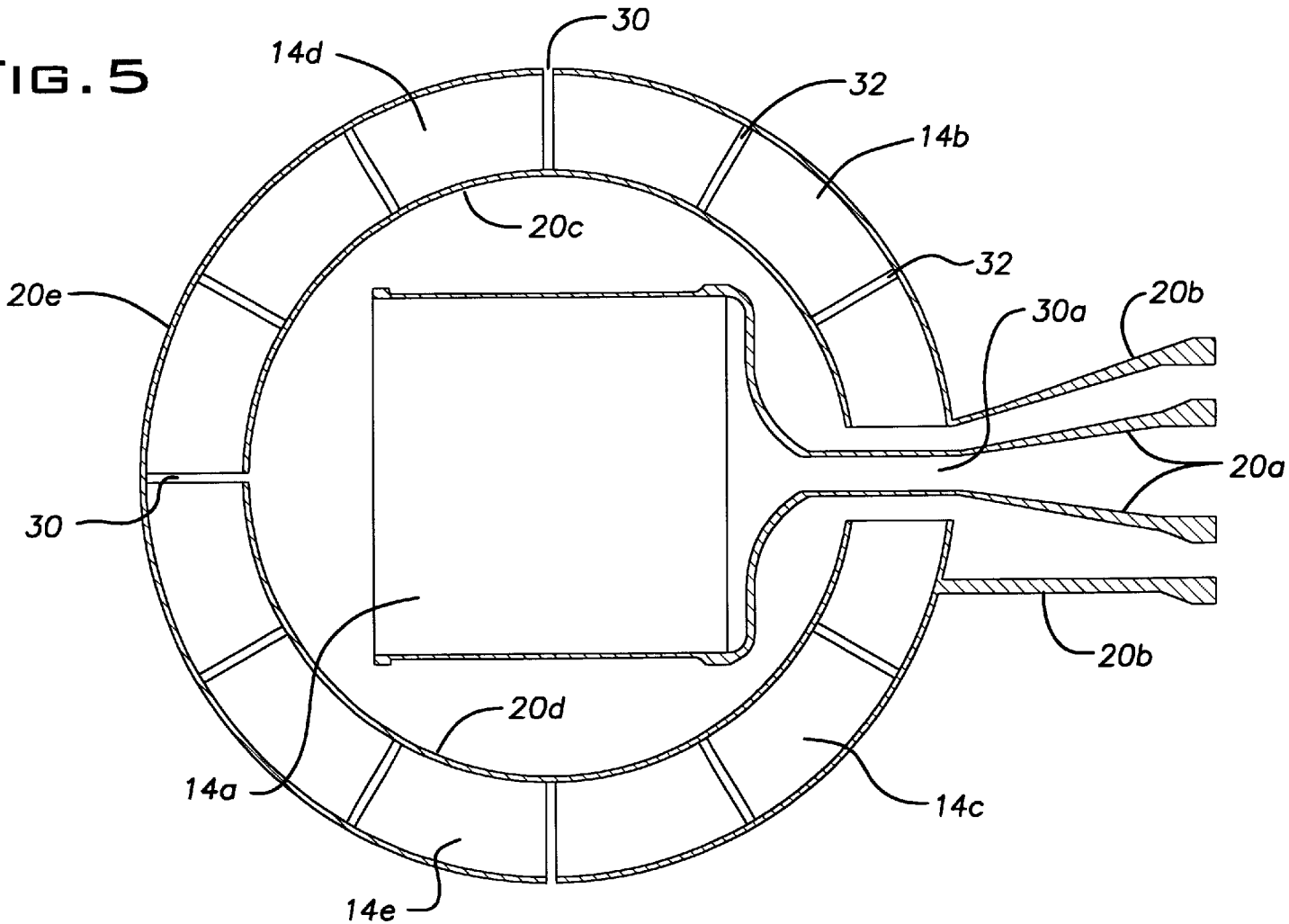
FIG. 5 shows a schematic diagram of the electrical layout of a dual heater according to the invention.

The temperature signals from the temperature sensing leads 34, 36 can be a small DC signal (in the millivolt range) the accuracy of which is not affected by the 240 VAC power supplied to the heater. Referring to FIG. 5, the resistive layer 14 is applied as a nearly square rectangular element surrounded by an annular element formed by four arcuate segments. The rectangle 14*a* is approximately 80 mm by 85 mm. The arcuate segments have an outer radius of about 91.5 mm and an inner radius of about 66.5 mm. The segments are generally symmetrically spaced around the rectangle 14*a*. Gaps 30 between the segments are 2 mm wide. Each of the four arcuate segments is divided into three subsegments by two radial masking gaps 32, which are 2 mm wide. The masking gaps 32 are necessary because of limitations on the masking method used to apply the resistive layer on the substrate. These masking gaps 32 do not believed significantly affect the electrical or heating characteristics and therefore are not discussed further. A 21 mm main gap 30*a* is provided between two of the segments to provide a passage for inner main bus bars 20*a*. Gap width and location can be modified to alter the electrical and heating characteristics. For example, the maximum power density can be reduced from 13.7 W/cm$^2$ to 12.7 W/cm$^2$ by making the main gap 30*a* 9 mm wide instead of 21 mm wide.

The inner main bus bars 20*a* are connected to respective legs of a two-phase power system providing a nominal 240 volts AC. The inner main bus bars are spaced 8 mm apart in the main gap 30*a*. Outer main bus bars 20*b* are connected to respective legs of the two-phase power system that can be controlled separately. The main bus bars 20*a*, 20*b* include terminals connected to leads from the power source. The terminals are spaced about 30 to 300 mm from the heating zone to reduce the effects of heat on the connections. For example, the bus bars are run along one of the tongues (25*a*, FIG. 2) supporting the heating zone so that the terminals are located on a cooler part or edge of the cook top. FIG. 5 shows a dual heater, that is, the rectangular element is supplied from one set of main bus bars and the arcuate segments are supplied from a different set of main bus bars to which power is controlled separately. The inner main bus bars 20*a* supply power to the bus bars applied on the rectangular resistive layer element. The outer main bus bars 20*b* supply power to the bus bars applied on the annular resistive layer elements.

The inner main bus bars 20*a* extend along opposite edges of the rectangular element 14*a*. The inner main bus bars 20*a* are slightly wider at the corners of the rectangular element 14*a* to facilitate the masking process. The outer main bus bars 20*b* extend along respective outer edges of the first and fourth arcuate segments 14*b*, 14*c*. The arcuate segments 14 are connected by bus bars 20 extending along outer and inner edges of pairs of the arcuate segments so that the segments are connected in series. For example, a bus bar 20*c* extends along the inner edges of the first and second arcuate segments 14*b*, 14*d*. Another bus bar 20*e* extends along the outer edge of the second and third arcuate segments 14*d*, 14*e*. A bus bar 20*d* extends along the inner edge of the third and fourth arcuate segments 14*e*, 14*c*. The arcuate segments are connected in a series circuit beginning at one of the outer main bus bars 20*b* and ending at the other outer main bus bar 20*b*. This arrangement provides about 700 W at 240 VAC when power is supplied only to the rectangular element 14*a* and about 1700 W at 240 VAC when power is supplied to all of the resistive elements.

Figure 6:
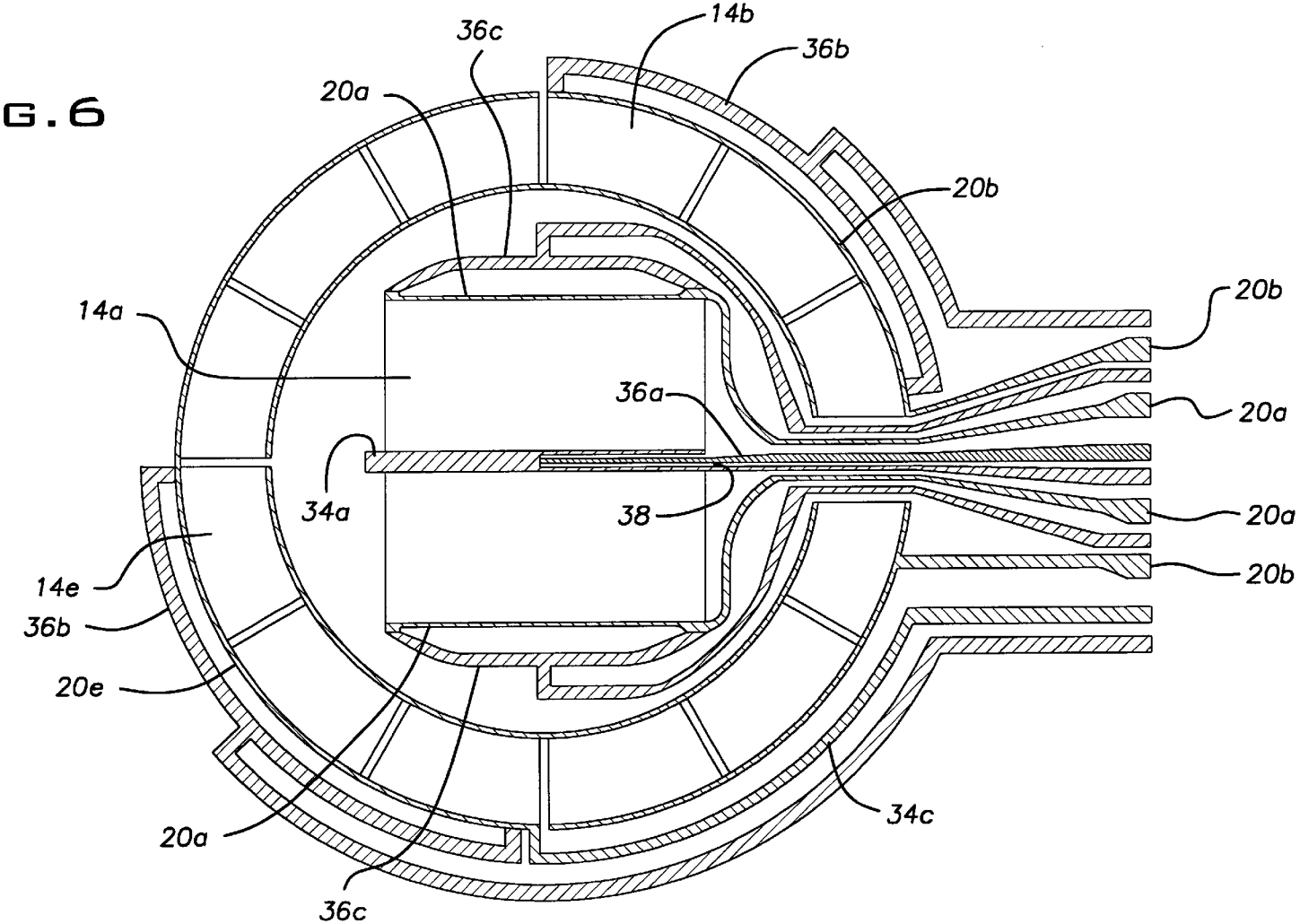
FIG. 6 shows a schematic diagram of the electrical layout of a dual heater having temperature sensing according to the invention.

Referring to FIG. 6, the heater includes substantially the same configuration of resistive layer elements 14 and bus bars 20 as shown in FIG. 5. That is, the resistive layer 14 is applied as a nearly square rectangular element surrounded by an annular element formed by four arcuate segments. The rectangular element 14*a*, however, is divided into two separate rectangular elements by a 5 mm gap 38. The arcuate segments 14 are connected by bus bars 20 extending along outer and inner edges of pairs of the arcuate segments. The main bus bars 20*a*, 20*b* are connected to separately controlled legs of a two-phase power system providing a nominal 240 volts AC.

Temperature sensing circuits similar to those shown in FIG. 4 are added to monitor and control the temperature of the resistive layer elements. Leads to the temperature sensor include a temperature control resistive lead 36*a* running to the center of the rectangular resistive element 14*a*. The resistive lead 36*a* is 1 mm wide and runs in the gap 38 in the rectangular element 14*a*. A temperature control conductive lead 34*a* runs through the gap 38 in the rectangular resistive element 14*a* and connects the two rectangular elements forming the nearly square rectangular element. The conductive lead 34*a* can extend slightly past the edges of the two rectangular elements to ensure that the two rectangular elements do not contact each other; a small amount of resistive thin film connecting the two rectangular elements could cause localized overheating. The conductive lead 34*a* is 5 mm wide across half of the rectangular element, until the conductive lead contacts the resistive lead 36*a*, where the conductive lead then splits into two parts, each of which is 1 mm wide and spaced 1 mm from opposite sides of the resistive lead 36*a*, running to the opposite edge of the rectangular element 14*a*. The temperature control conductive lead 34*a* and resistive lead 36*a* are connected to the temperature controller, which monitors the temperature of the heater and controls the power to the bus bars 20 to maintain a desired temperature.

Leads to the temperature sensor also include a temperature limiting resistive lead 36*b* following an arcuate path spaced about 3 mm from the outside edge of some of the annular resistive element arcuate segments 14*a*. Ends of the resistive lead 36*b* extend inwardly to connect to one of the bus bars 20 on the resistive layer 14. The temperature limiting resistive leads 36*b* are 4 mm wide. The outer main bus bar 20*b* extending along the outer edge of the first arcuate segment 14*b* serves as an outer temperature limiting conductive lead. Thus, the bus bar 20*b* connected to the resistive lead 36*b* serves the dual purposes of supplying power to the first arcuate segment 14*b* and providing a temperature sensing signal. The resistive lead 36*b* is connected to the bus bar 20*b* at or near opposite ends of the arcuate segment 14*b* and contacts the bus bar 20*b* only where the temperature is to be sensed. A similar temperature limiting sensor can be provided for other arcuate segments. An example is shown for the third segment 14*e*. Because there is no lead running to the outer bus bar 20*e* on the third segment 14*e*, an outer temperature limiting conductive lead 34*c* is connected between the controller and the bus bar 20*e*.

A pair of inner temperature limiting resistive leads 36*c* connects to the rectangular resistive element 14*a* near corners of the rectangular element. Temperature is sensed near the corners of the rectangular element. Thus, the inner main bus bars 20*a* serve the dual purposes of supplying power to the rectangular element 14*a* and providing a temperature sensing signal.

The inner and outer main bus bars 20*a*, 20*b*, outer temperature limiting conductive lead 34*c*, and inner and outer temperature limiting resistive leads 36*c*, 36*b* are connected to the temperature controller, which monitors the temperature of the heater where the resistive leads meet the corresponding bus bar or conductive leads. If the temperature exceeds a specified maximum desired temperature, the controller overrides the control based on the signals from the temperature control sensors and reduces or cuts off power to the bus bars 20.

The present disclosure describes several embodiments of the invention, however, the invention is not limited to these embodiments. Other variations are contemplated to be within the spirit and scope of the invention and appended claims.

What is claimed is:

1. A heater comprising:

a substrate having a heating zone;

a resistive layer disposed on at least part of the substrate heating zone and forming an annular heating element divided into arcuate segments; and conductive bus bars extending respectively along inner and outer edges of the arcuate segments electrically connecting the arcuate segments in series.

2. A heater according to claim 1 wherein the bus bars are disposed on edges of the arcuate segments.

3. A heater according to claim 1 wherein the bus bars are respectively connected along inner and outer edges of the arcuate segments.

4. A heater according to claim 3 wherein a first one of the bus bars is connected along a first edge of a first one of the arcuate segments and a second one of the bus bars is connected along a second edge of the first arcuate segment opposite the first edge and along an edge of a second one of the arcuate segments.

5. A heater according to claim 1 wherein the resistive layer includes first, second, third, and fourth of the arcuate segments, a first one of the bus bars is connected along an outer edge of the first segment, a second one of the bus bars is connected along inner edges of the first and second segments, a third one of the bus bars is connected along outer edges of the second and third segments, a fourth one of the bus bars is connected along inner edges of the third and fourth segments, and a fifth one of the bus bars is connected along an outer edge of the fourth segment.

6. A heater according to claim 5 wherein the first and fifth bus bars are connected to a power source.

7. A heater according to claim 1 wherein the resistive layer includes first, second, third, fourth, fifth, sixth, seventh, and eighth of the arcuate segments, a first one of the bus bars is connected along an inner edge of the first segment, a second one of the bus bars is connected along outer edges of the first and second segments, a third one of the bus bars is connected along inner edges of the second and third segments, a fourth one of the bus bars is connected along outer edges of the third and fourth segments, a fifth one of the bus bars is connected along inner edges of the fourth and fifth segments, a sixth one of the bus bars is connected along outer edges of the fifth and sixth segments, a seventh one of the bus bars is connected along inner edges of the sixth and seventh segments, an eighth one of the bus bars is connected along outer edges of the seventh and eighth segments, and a ninth one of the bus bars is connected along an inner edge of the eighth segment.

8. A heater according to claim 7 wherein the first and ninth bus bars are connected to a power source.

9. A heater according to claim 1 wherein the resistive layer further comprises a separate element disposed within the annular element and further comprising conductive bus bars disposed along opposite edges of the separate element.

10. A heater according to claim 9 wherein the separate element bus bars are connected to the annular element bus bars so that the separate element is electrically connected in parallel with the annular element.

11. A heater according to claim 9 wherein the separate element bus bars are arranged so that power to the separate element can be controlled separately from the annular element.

12. A heater according to claim 1 further comprising a resistive temperature sensing lead connected from a conductive element disposed adjacent the resistive layer to a temperature sensor.

13. A heater according to claim 12 wherein the conductive element is one of the bus bars.

14. A heater according to claim 12 further comprising a conductive temperature sensing lead connected to the conductive element.

15. A heater according to claim 14 wherein the temperature sensing leads are connected to a controller for monitoring the temperature of the heater where the conductive leads meet the resistive leads.

16. A heater according to claim 12 wherein the conductive element is a conductive temperature sensing lead.

17. A heater according to claim 1 wherein gaps between different segments of the resistant layer are filled with insulating material.

18. A heater according to claim 1 further comprising a dielectric layer disposed between the resistive layer and the substrate.

19. A heater comprising:

a substrate having a heating zone;

a resistive layer disposed on at least part of the substrate heating zone and forming an annular heating element divided into arcuate segments and a rectangular element disposed within the annular element;

annular element conductive bus bars disposed on edges of the arcuate segments electrically connecting the arcuate segments in series, wherein a first one of the annular element bus bars is connected along a first edge of a first one of the arcuate segments and a second one of the annular element bus bars is connected along a second edge of the first arcuate segment opposite the first edge and along an edge of a second one of the arcuate segments, a last one of the annular element bus bars is connected along an edge of a last one of the arcuate segments in the series, and the first and last annular element bus bars are connected to a power source; and rectangular element conductive bus bars disposed along opposite edges of the rectangular element and connected to the power source.

20. A heater according to claim 19 wherein the rectangular element bus bars are connected to the annular element bus bars so that the rectangular element is electrically connected in parallel with the annular element.

21. A heater according to claim 19 wherein the rectangular element bus bars are arranged so that power to the rectangular element can be controlled separately from the annular element.

22. A heater according to claim 19 further comprising a resistive temperature sensing lead connected to a conductive element disposed adjacent the resistive layer, wherein the temperature sensing leads are connected to a controller for monitoring the temperature of the heater.

* * * * *